United States Patent [19]

Okihara et al.

[11] Patent Number: 4,535,311

[45] Date of Patent: Aug. 13, 1985

[54] CONTACT SUPPORT MEANS FOR AN ELECTROMAGNETIC RELAY

[75] Inventors: Naoto Okihara; Masayuki Morimoto; Tatsumi Ide, all of Tokyo, Japan

[73] Assignee: NEC Corporation, Tokyo, Japan

[21] Appl. No.: 610,685

[22] Filed: May 16, 1984

[30] Foreign Application Priority Data

May 20, 1983 [JP] Japan ..... 58-88449
Sep. 30, 1983 [JP] Japan ..... 58-152899[U]

[51] Int. Cl.[3] ..... H01H 67/02
[52] U.S. Cl. ..... 335/124; 335/300
[58] Field of Search ..... 335/43, 44, 45, 128, 335/300, 133, 125, 124

[56] References Cited

U.S. PATENT DOCUMENTS 2,528,734 11/1950 Brass ..... 335/300 X
2,627,007 1/1953 Richards ..... 335/300 X
4,033,255 7/1977 Kleist et al. ..... 335/300 X

FOREIGN PATENT DOCUMENTS 574434 1/1946 United Kingdom ..... 335/43

*Primary Examiner*—George Harris
*Attorney, Agent, or Firm*—Laff, Whitesel, Conte & Saret

[57] ABSTRACT

In an electromagnetic relay, a first stationary contact member (25) has a first, elongated portion (25*a*) extending between first and second insulative supports and a second portion (25*b*) extending in a direction normal to the first portion. The second portion includes a first stationary contact (25*c*) element and a heat radiating surface (25*b*, 25*f*) for radiating a substantial amount of heat generated by an arc so that the amount of heat which is conducted to the first support (13) is insufficient to cause a fusion to occur therein. A second stationary contact member (26) has a third, elongated portion (26*a*) extending between the first and second supports and a fourth, elongated portion (26*b*) extending in a direction normal to the third portion in spaced relationship to the second portion (25*b*) and having a second stationary contact element (26*c*) in opposed relationship with the first stationary contact element. A coiled-core structure is secured between the insulative supports for operating a movable contact member between the first and second stationary contact elements.

11 Claims, 6 Drawing Figures a = 1 mm
b = 6 mm
c = 1 mm
d = 3.5 mm
e = 6 mm
f = 6 mm

CONTACT SUPPORT MEANS FOR AN ELECTROMAGNETIC RELAY

BACKGROUND OF THE INVENTION

The present invention relates generally to switching devices, and more particularly to an electromagnetic relay of the heavy duty type.

Recent advances in integrated circuit techniques have promoted efforts in developing compact, lightweight devices for use in communication equipments, control systems and household appliances. In automotive vehicles for example, the recent tendency is toward using integrated circuits to control a variety of peripheral devices that require a heavy current for operation. Although semiconductor switching devices may be considered as an interface between the integrated circuits and peripheral devices in order to take advantage of their compactness and their adaptability to integrated circuits during manufacture, they are inappropriate due to their incapability to operate under heavy current loads and particularly due to their susceptability to surge currents caused by lightning or the like. Electromagnetic relays can be considered as best devices to act as such interfaces, although they occupy a substantial volume.

A small-sized electromagnetic relay of the heavy duty type which is known in the art for use in printed circuits comprises a pair of stationary contact members. Each of these contact members is a rectangular metal strip which is bent into a generally L-shaped configuration so that their contact elements are located in opposite positions when secured to insulative supports between which a core-and-armature structure is located, with a movable contact being located between the stationary contacts. Disadvantages are that the contact spacing is not precisely determinable and that the prior art configuration does not permit the use of an automatic assemblage machine with which the stationary contact members are secured to the supports in a single operation.

In a switching device shown and described in U.S. Pat. No. 4,044,212, two stationary contact members are punched from a single metal strip into a shape contoured so that they are snap-action engaged with insulative supports. While this switching device may be successful in eliminating the problems mentioned above, there is still a disadvantage in that heat generated by arcing between contacts tends to be conducted to one of the insulative supports to fuse a portion of it, causing the contact spacing to deviate from the set value, or vaporize it, generating organic gas which would contaminate the contact elements and reduce the insulation resistance.

SUMMARY OF THE INVENTION

It is therefore an object of the present invention to provide an electromagnetic relay which is free from the disadvantage of a prior art electromagnetic relay by radiating arc-generated heat.

The electromagnetic relay of the present invention comprises a pair of first and second insulative supports in spaced apart parallel relationship. A first stationary member of conductive material has a first, elongated portion extending between the first and second supports and a second portion extending in a direction normal to the first portion. The second portion includes a first stationary contact element and a heat radiating surface for radiating a substantial amount of heat generated in the first stationary contact element in response to an arc on the surface of the first stationary contact element so that heat conducted to the supports is insufficient to cause them to fuse or vaporize. A second stationary member of conductive material has a third, elongated portion extending between the first and second supports and a fourth, elongated portion extending in a direction normal to the third portion in spaced relationship to the second portion and having a second stationary contact element in opposed relationship with the first stationary contact element. A movable contact member is arranged to move between the first and second stationary contact elements in response to a magnetic flux generated by an arrangement including a coiled-core structure disposed between the insulative supports and an armature.

BRIEF DESCRIPTION OF THE DRAWINGS

The invention will be described in further detail with reference to the accompanying drawings, in which.

DETAILED DESCRIPTION

Figure 1:
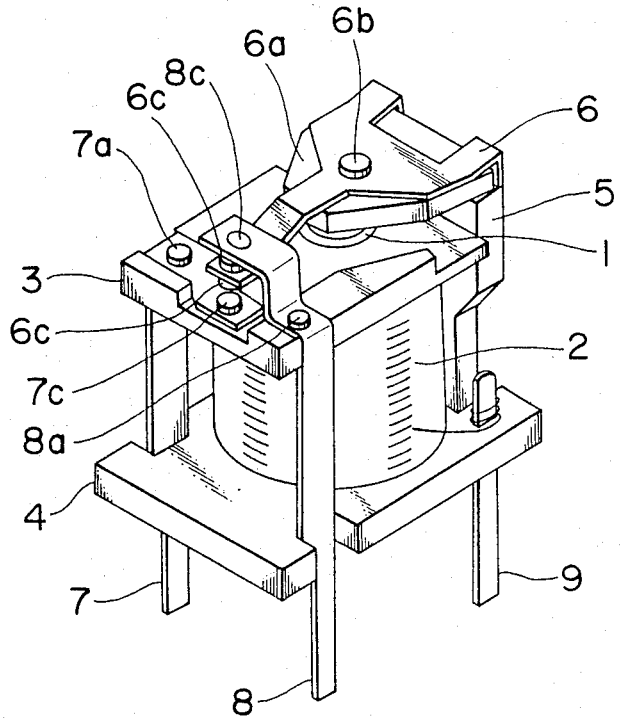
FIG.1 PRIOR ART
FIG. 1 is an illustration of a prior art electromagnetic relay.

Before going into the detail of the present invention reference is first made to FIG. 1 in which a prior art electromagnetic relay is shown as comprising a cylindrical core 1 with a coil 2 wound thereon secured between upper and lower insulative supports 3 and 4. An L-shaped yoke 5 has it bottom portion, not visible, secured to the lower end of the core 1 and its vertical portion extending parallel to the core. A flexible conductive member 6 of generally Y-shaped configuration to which an armature member **6*a* is attached by rivet 6*b*, is fastened to the vertical portion of the yoke 5 and provided with a movable contact 6*c*. A generally L-shaped stationary first contact member 7 having a stationary contact 7*c* is fixed to the upper support 3 by a rivet 7*a*. A generally L-shaped stationary second contact member 8 having a stationary contact 8*c* is likewise fixed to the upper support 3 by a rivet 8*a* so that the stationary contacts 7*c* and 8*c* are in vertically spaced apart opposite positions with the movable contact 6*c* being movably located between them. To the lower support 4 is secured a lead-wire terminal 9 around which one end of the coil 2** is wrapped for solder connection.

The spacing between the stationary contacts **7*c* and 8*c* should be maintained with a high degree of precision. However, in the prior art relay, the stationary contact member 8 is formed of a metal strip which is bent at intermediate portions. It is thus difficult to provide uniformity in contact spacing. The prior art relay has a further disadvantage in that during assemblage the stationary contact members 7 and 8 must be approached to the upper and lower supports in opposite directions to each other, which makes it difficult to employ an automatic assemblage machine. A still further disadvantage is that the production of an arc between make contacts heats the upper insulative support 3** to the point where it is fused causing a deviation of spacing contact or vaporized generating an organic gas that contaminates the surfaces of the contacts.

Figure 2:
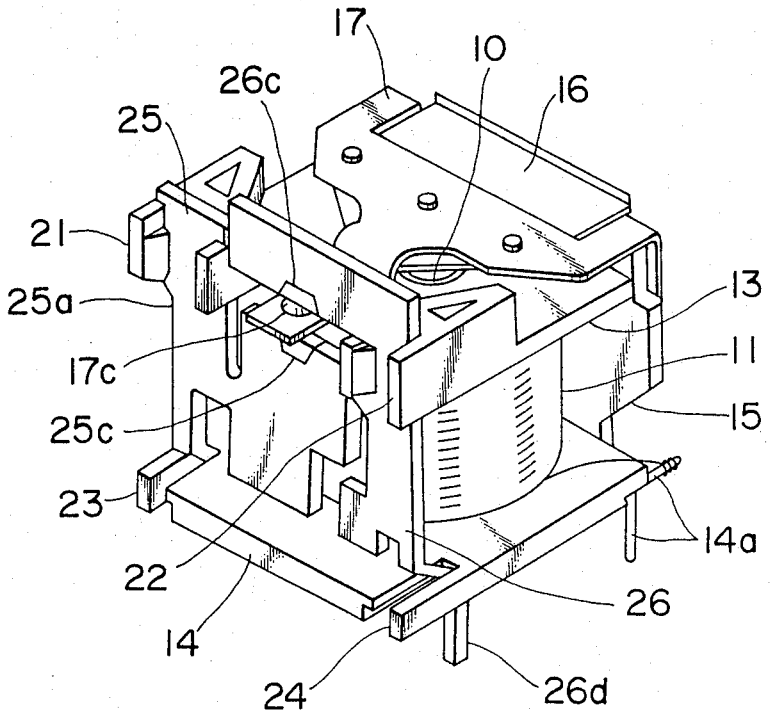
FIG. 2 is a perspective view of an electromagnetic relay constructed according to the present invention.
Figure 3:
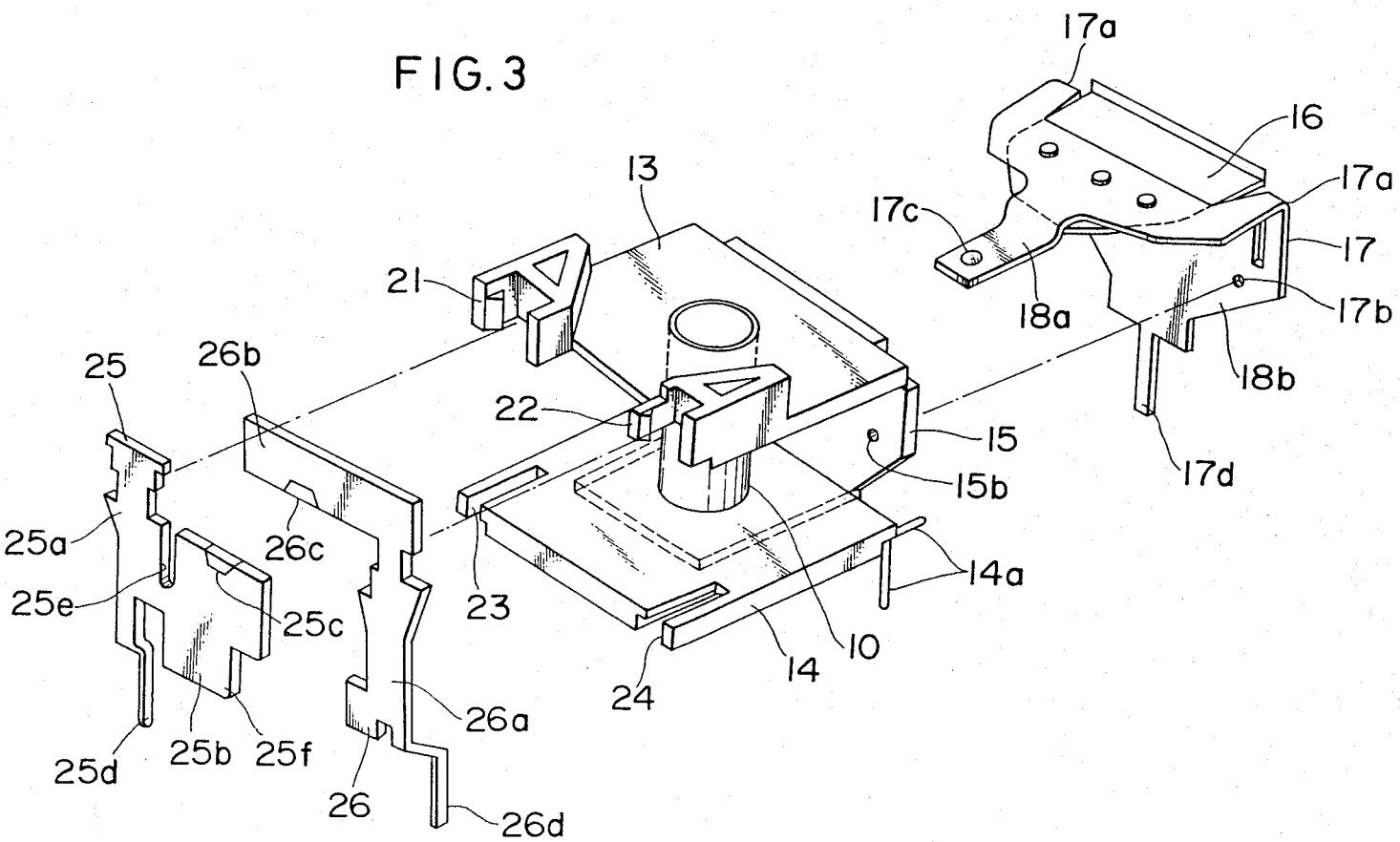
FIG. 3 is an exploded, perspective view of the electromagnetic relay of FIG. 2.
Figure 4:
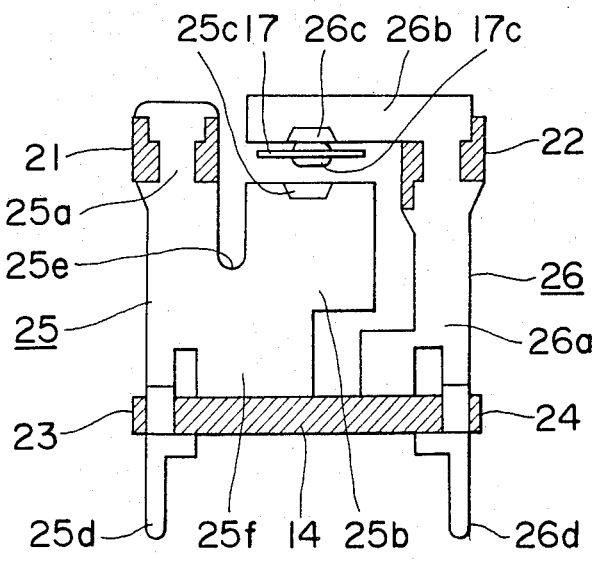
FIG. 4 is a view illustrating the electromagnetic relay of FIG. 2 in front elevation.

An electromagnetic relay constructed according to the present invention is shown in FIGS. 2 to 4. A hollow cylindrical core 10 with a coil 11 is secured between upper and lower insulative supports 13 and 14 formed of plastic or synthetic resin. The lower support 14 includes a terminal 14*a* to which one end of the coil 11 is soldered for connection to an external circuit. An L-shaped yoke 15 provides a magnetic circuit from the lower end of the core 10 to an armature 16. A movable contact member 17 formed of phosphor bronze having a thickness of 0.18 mm is provided which is bent at shoulder portions 17*a* defining a generally Y-shaped upper spring portion 18*a* to which the armature 16 is attached and a vertically extending portion 18*b* which is formed with a lead-wire terminal 17*d* and is secured to the yoke 15 by rivets through aligned holes 17*b*, 15*b*. A pair of electrical contact elements 17*c* are provided one on each side of the spring portion 18*a*.

The upper insulative support 13 is formed with a pair of molded gripping portions 21 and 22 each having forked projections and the lower insulative support 14 is also provided with a pair of identically shaped gripping portions 23 and 24. Stationary contact members 25 and 26 of phosphor bronze, nickel silver or an alloy of Cu-Fe-P are provided. These members are punched from a single flat metal strip of a sufficient thickness to withstand contact pressure as applied to the edge thereof. In a practical embodiment, each of these stationary contact members has a thickness of 1 mm. The stationary contact member 25 has an elongated vertical portion 25*a* which is configured to conform to the gripping portions 21 and 23 for snap-action insertion thereto and a heat radiating horizontal portion 25*b* having a sufficient amount of area to radiate heat and a heat radiating downward, tab portion 25*f* which contacts with the lower support 14 to provide rigidity to the horizontal heat radiating portion 25*b*. An electrical contact element 25*c* of an alloy of Ag-Ni or a compound oxide alloy such as AgCdO is press-fitted into a complementarily shaped identation on the upper edge of the horizontal portion 25*b*. A slit 25*e* is formed between the elongated vertical portion 25*a* and the heat radiating portion 25*b* to increase the distance measured along the surface of member 25 from the contact element 25*c* to the upper end of vertical portion 25*a* which engages the gripping portion 21.

The stationary contact member 26 comprises an elongated vertical portion 26*a* which is configured to conform to the gripping portions 22 and 24 to provide snap action insertion thereto and an elongated horizontal portion 26*b* having a press-fitted electrical contact element 26*c* in a position opposed to the contact 25*c* of the other stationary contact member 25. The stationary contact members 25 and 26 are simultaneously assembled with the upper and lower supports by having their upper ends simultaneously inserted to the gripping portions 21 and 22 and the lower ends inserted to the gripping portions 23 and 24 in a single snap action as best seen in FIG. 4. This snap-action insertion allows an automatic assemblage machine to be employed to increase production efficiency and ensures a high degree of precision for spacing between the stationary contact elements 25*c* and 26*c*. The stationary contact members 25 and 26 include lead-wire terminals 25*d* and 26*d*, respectively, which extend from the lower support 14 for connection to external circuits as by wire wrapping or soldering. The electromagnetic relay is encased in an air-tight housing, not shown.

When the coil 11 is not energized, the armature member 16 remains in a higher position in which the movable contact 17*c* is in contact with the upper stationary contact 26*c* to complete a circuit which carries a relatively small amount of current. When the coil 11 is energized, the armature member 16 is attracted downward, the movable contact 17*c* is brought into contact with the lower stationary contact 25*c* to complete a circuit which carries a large amount of current. Arc is produced when the movable contact 17*c* disengages from the lower stationary contact 25*c* and heat is built up in the stationary contact 25*c* which propagates through the heat radiating portion 25*b* to the vertical arm portion 25*a*. Due to the provision of slit 25*e*, the heat propagates through a U-shaped path to the upper gripping portion 21 and to the lower gripping portion 23 and will reach them at a reduced temperature. A greater portion of the heat so generated is dissipated from the surface of the radiating portions 25*b* and 25*e*.

Figure 5:
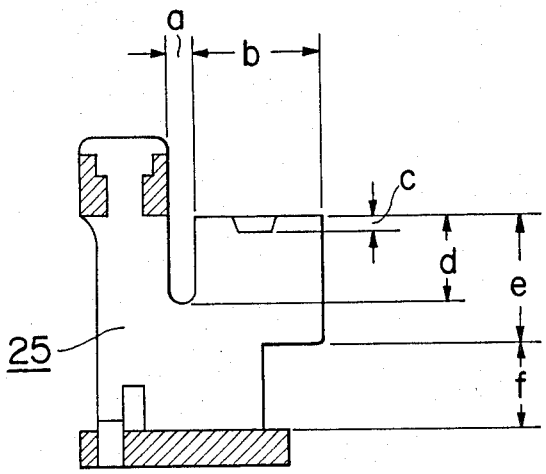
FIG. 5 is a front view of the first stationary contact member and its dimensions used in experiments to confirm the heat radiating performance.

Experiments were conducted to confirm the heat radiating characteristic of the present invention. In the experiments, the electromagnetic relay was placed in a test circuit which applies DC 100 volts through a current limiting resistor to generate a current of 1 ampere. The movable contact 17*c* was initially set in a position contacting with the stationary make contact 25*c* and then the current was passed through the contacts 25*c* and 17*c*. The movable contact 17*c* was then forcibly disengaged from the make contact 25*c* to produce an arc therebetween. This arc was sustained until the forked projections of the gripping portion 21 begin to fuse and the time period lapsed from the instant the arc was produced and the instant the fusion occurred was measured. With the dimensions shown in FIG. 5, a period of 13 seconds was taken to fuse the gripping portion 21 of the insulative support 13. For purposes of comparison, an electromagnetic relay having a stationary contact member 25 with no slit 25*e* and no tab portion 25*f* was placed in the test circuit. The measurement showed that a period of 5 seconds was taken to cause a fusion to occur in the gripping portion 21.

Figure 6:
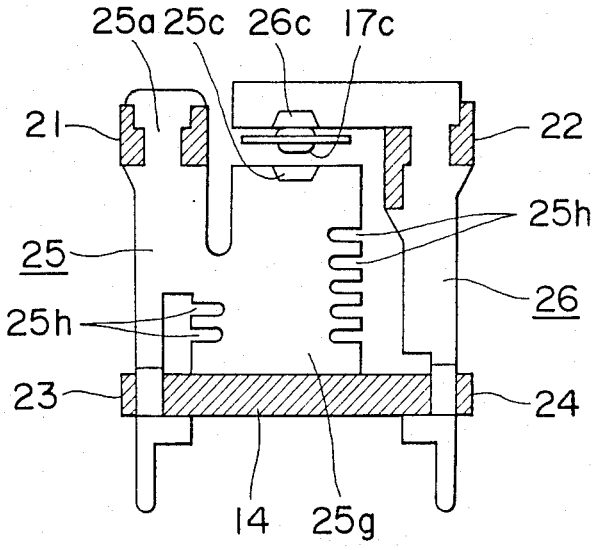
FIG. 6 is an illustration of a modification of the present invention.

The heat radiation performance is increased in a manner as shown in FIG. 6 in which the first stationary contact member 25 is provided with a plurality of slits 25*h* on opposite edges of a heat radiating portion 25*g*.

What is claimed is:

1. An electromagnetic relay comprising:

a pair of first and second insulative supports in spaced apart parallel relationship;

a first stationary member of conductive material having a first, elongated portion extending between said first and second supports and a second portion extending in a direction normal to said first portion, said second portion having a first stationary contact element therein and a heat radiating surface for radiating a substantial amount of heat generated in said first stationary contact element in response to an arc on the surface of said first stationary contact element so that heat conducted to said supports is insufficient to cause them to fuse or vaporize;

a second stationary member of conductive material having a third, elongated portion extending between said first and second supports and a fourth, elongated portion extending in a direction normal to said third portion in spaced relationship to said second portion, said fourth portion having a second stationary contact element therein in opposed relationship with said first stationary contact element;

a movable member of conductive material having an elongated portion movable between said first and second stationary contact elements and having a pair of contact elements one on each side thereof for selectively making contact with one of said first and second stationary contact elements; and means secured between said first and second supports for generating magnetic flux in response to a current supplied thereto for moving the elongated portion of said movable member into contact with one of said first and second stationary contact elements.

2. An electromagnetic relay as claimed in claim 1, wherein said heat radiating surface has a portion extending to a point proximate to said second support.

3. An electromagnetic relay as claimed in claim 1, wherein said heat radiating surface has a portion engaged with said second support.

4. An electromagnetic relay as claimed in claim 1, wherein said first stationary member is formed with a slit between said heat radiating surface and said first, elongated portion to increase the distance measured along the surface thereof from said first stationary contact element to a point where said elongated first portion is in engagement with said first support.

5. An electromagnetic relay as claimed in claim 1, wherein said heat radiating surface has a portion extending to a point proximate to said second support and is formed with a slit to increase the distance measured along the surface from said first stationary contact element to a point where said first portion is in engagement with said first support.

6. An electromagnetic relay as claimed in claim 1, wherein said heat radiating surface has a portion engaged with said second support and is formed with a slit to increase the distance measured along the surface from said first stationary contact element to a point where said first portion is in engagement with said first support.

7. An electromagnetic relay as claimed in claim 2, wherein said heat radiating surface is formed with a plurality of heat radiating fins.

8. An electromagnetic relay as claimed in claim 3, wherein said heat radiating surface is formed with a plurality of heat radiating fins.

9. An electromagnetic relay as claimed in claim 5, wherein said heat radiating surface is formed with a plurality of heat radiating fins.

10. An electromagnetic relay as claimed in claim 6, wherein said heat radiating surface is formed with a plurality of heat radiating fins.

11. An electromagnetic relay as claimed in claim 1, wherein said first support is provided with a pair of first and second gripping portions and said second support is provided with a pair of third and fourth gripping portions, said first, elongated portion having a punched contour complementary to said first and third gripping portions to allow the first, elongated portion to be inserted thereto for gripping engagement, and said third, elongated portion having a punched contour complementary to said second and fourth gripping portions to allow the second, elongated portion to be inserted thereto for gripping engagement.

* * * * *